US009916955B2

(12) United States Patent
Couzon et al.

(10) Patent No.: US 9,916,955 B2
(45) Date of Patent: Mar. 13, 2018

(54) DEVICE FOR JOINING A BIMETAL STRIP AND A COMPONENT FORMING A SUPPORT FOR SAID BIMETAL STRIP, AND ELECTRICAL PROTECTION UNIT COMPRISING SAME

(71) Applicant: SCHNEIDER ELECTRIC INDUSTRIES SAS, Rueil Malmaison (FR)

(72) Inventors: David Couzon, Froges (FR); Jose Garcia, Agey (FR); Sylvain Battail, Pontcharraf (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/345,889

(22) Filed: Nov. 8, 2016

(65) Prior Publication Data

US 2017/0178852 A1 Jun. 22, 2017

(30) Foreign Application Priority Data

Dec. 21, 2015 (FR) ..... 15 62925

(51) Int. Cl.
*H01H 71/16* (2006.01)
*H01H 71/74* (2006.01)
(Continued)

(52) U.S. Cl.
CPC ..... *H01H 71/16* (2013.01); *H01H 71/40* (2013.01); *H01H 71/7427* (2013.01);
(Continued)

(58) Field of Classification Search
CPC ..... H01H 71/16–2071/168; H01H 71/7418–2071/7454
See application file for complete search history.

(56) References Cited

U.S. PATENT DOCUMENTS 5,844,466 A 12/1998 Fraisse
2013/0009743 A1 1/2013 Rosch et al.

FOREIGN PATENT DOCUMENTS

DE 462 367 7/1928
EP 0 291 835 A2 11/1988
(Continued)

OTHER PUBLICATIONS

French Preliminary Search Report dated Aug. 8, 2016 in French Application 15 62925, filed on Dec. 21, 2015 (with English Translation of Categories of cited documents & Written Opinion).

*Primary Examiner* — Ramon M Barrera
(74) *Attorney, Agent, or Firm* — Oblon, McClelland, Maier & Neustadt, L.L.P.

(57) ABSTRACT

A device for joining a bimetal strip and a component that acts as a support for the bimetal strip in a current breaking unit, the bimetal strip being electrically connected by a free end, to a input connection area, and by another end, by way of which the bimetal strip is fixed to the support, to a output connection area. The bimetal strip is mounted to pass through the support to be fixed at different locations along the length of the bimetal strip, the bimetal strip having a first part and a second part that are situated respectively on one side and the other of the support, the first part being on the side of the free end, corresponding to the usable surface of the bimetal strip, the length of the usable surface being variable depending on the insertion length of the bimetal strip in the support, the insertion length being determined depending on the calibre of the unit to obtain a constant thermal profile, regardless of the calibre, and to an electrical protection unit with same.

6 Claims, 3 Drawing Sheets

Figure 1:
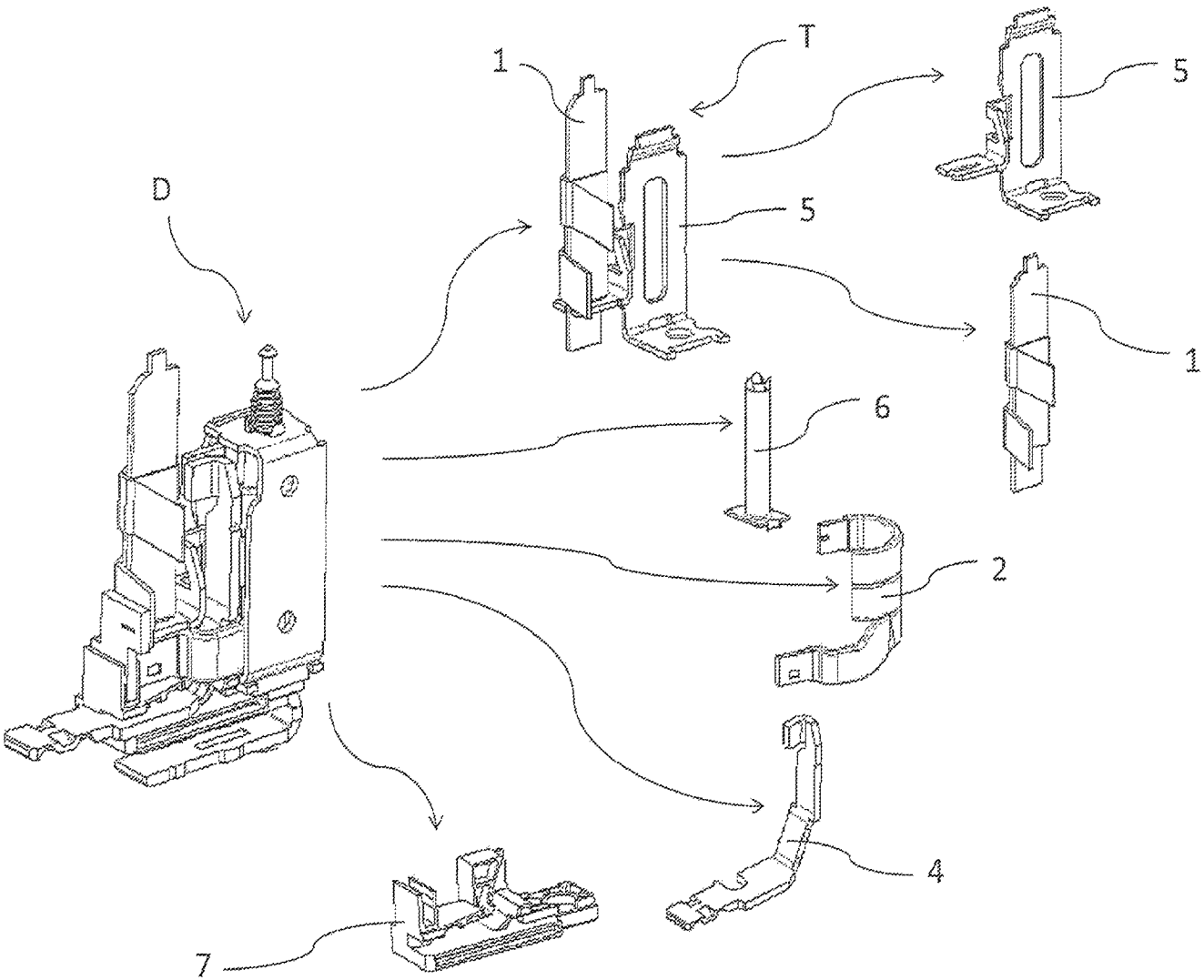

(51) Int. Cl.

| | |
|---|---|
| ***H01H 71/40*** | (2006.01) |
| *H01H 71/24* | (2006.01) |
| *H01H 71/08* | (2006.01) |

(52) U.S. Cl.
CPC ..... *H01H 71/7436* (2013.01); *H01H 71/164* (2013.01); *H01H 71/2463* (2013.01); *H01H 2071/084* (2013.01)

(56) References Cited

FOREIGN PATENT DOCUMENTS

| | | |
|---|---|---|
| EP | 0 831 510 A1 | 3/1998 |
| EP | 2 544 206 A1 | 1/2013 |
| FR | 2 669 144 | 5/1992 |
| GB | 2 205 998 A | 12/1988 |

DEVICE FOR JOINING A BIMETAL STRIP AND A COMPONENT FORMING A SUPPORT FOR SAID BIMETAL STRIP, AND ELECTRICAL PROTECTION UNIT COMPRISING SAME

TECHNICAL DOMAIN

The present invention relates in a general manner to thermal bimetal trips for current switching units, particularly circuit breakers. It relates more particularly to a device for joining a bimetal strip and a component that acts as a support for this bimetal strip in a current switching unit, said bimetal strip being electrically connected by a first end known as the free end to a first connection area known as the input connection area, and by another end, by way of which this bimetal strip is fixed to the abovementioned support, to a second connection area known as the output connection area.

STATE OF THE PRIOR ART

It is known that a thermal bimetal trip in a current switching unit provides protection against overcharges, the temperature rise of the bimetal strip being representative of the temperature rise of the unit or of the protected electrical installation, so as to trip the switching unit when this temperature rise exceeds a predetermined threshold. The temperature of the bimetal strip can be increased either directly by passing current through the bimetal strip, or in a more conventional manner, indirectly by passing current into an insulated electrical heater in thermal contact with the bimetal strip.

Also known is joining this bimetal strip to a supporting component made of an electrically conducting material.

For example, document FR 2 669 144 is known that describes such a joining. This document describes the joining in two perpendicular planes of a bimetal strip and a flat conducting component acting as a support for same, this joining being embodied by inserting the lower part of the bimetal strip shaped as a tenon into a recess serving as a mortise made in the supporting component.

In such a device, the current circulates from an input terminal, through a tape surrounding the bimetal strip, then from the free end of the bimetal strip, through the length of the bimetal strip, then through the bimetal strip support, then into the winding of an electromagnetic coil, same being electrically connected to an output terminal of the unit.

In such a device, the foot of the bimetal strip, corresponding to the fixing point of the bimetal strip on the support, has a smaller section corresponding to the section of the abovementioned tenon. This small section of the bimetal strip results in a high power generated by the subassembly comprising the bimetal strip and the support. This reduced passage section is therefore advantageous for weak currents but disadvantageous for strong currents.

Now, the problem currently arises of making a higher voltage current pass with a constant volume.

DISCLOSURE OF THE INVENTION

The present invention resolves this problem and proposes a device for joining a bimetal strip to its support so as to increase the operating current of the unit comprising same, while preserving one and the same spatial requirement for this unit, and also a current switching unit comprising such a joining device.

To that effect, the object of the present invention is a joining device of the abovementioned type, this device being characterized in that this bimetal strip is mounted so as to pass through the abovementioned support so as to be able to be fixed at different locations along the length of this bimetal strip, said bimetal strip thus having a first and a second part that are situated respectively on one side and the other of the abovementioned support, the first part being situated on the side of the free end of the bimetal strip, corresponding to the surface known as the usable surface of this bimetal strip, the length of this usable surface being variable depending on the insertion length of this bimetal strip in the support, this insertion length being determined depending on the calibre of the unit so as to obtain a constant thermal profile, regardless of the calibre.

According to a particular feature, the electrical connection area, known as the output connection area, is electrically connected to the second part of the aforementioned bimetal strip.

According to another feature, the bimetal strip is fixed to the support by welding.

Another object of the present invention is an electrical protection unit comprising a thermal trip comprising a bimetal strip, this unit comprising a device for joining the bimetal strip to its support, comprising the abovementioned features taken alone or combined.

According to another feature, this unit comprises an electromagnetic trip comprising a coil, this coil comprising a first end electrically connected to the abovementioned second part of the bimetal strip and a second end electrically connected to the abovementioned output area.

According to one feature, this unit is a low voltage circuit breaker.

Figure 3:
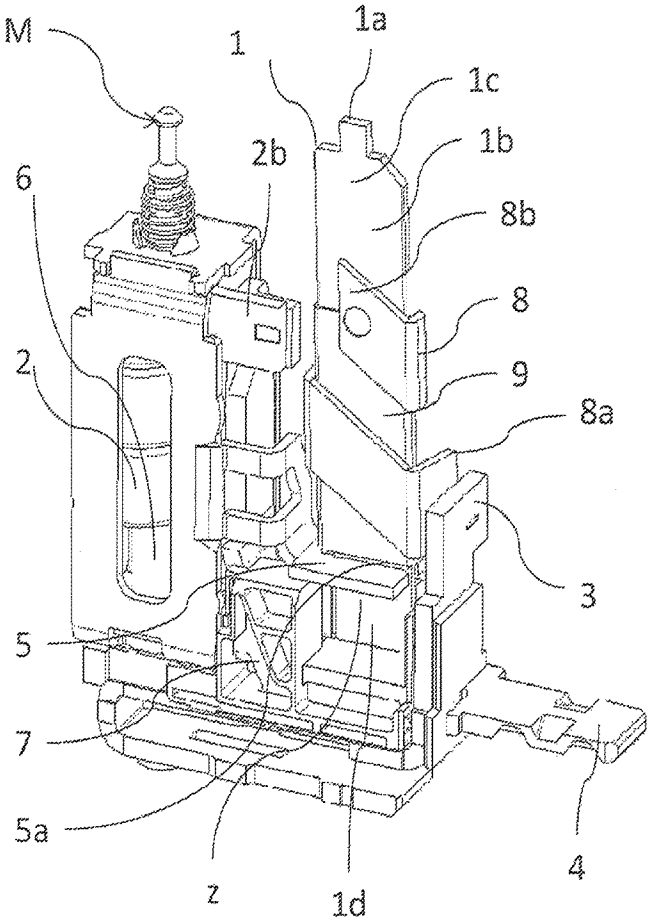
Figure 2:
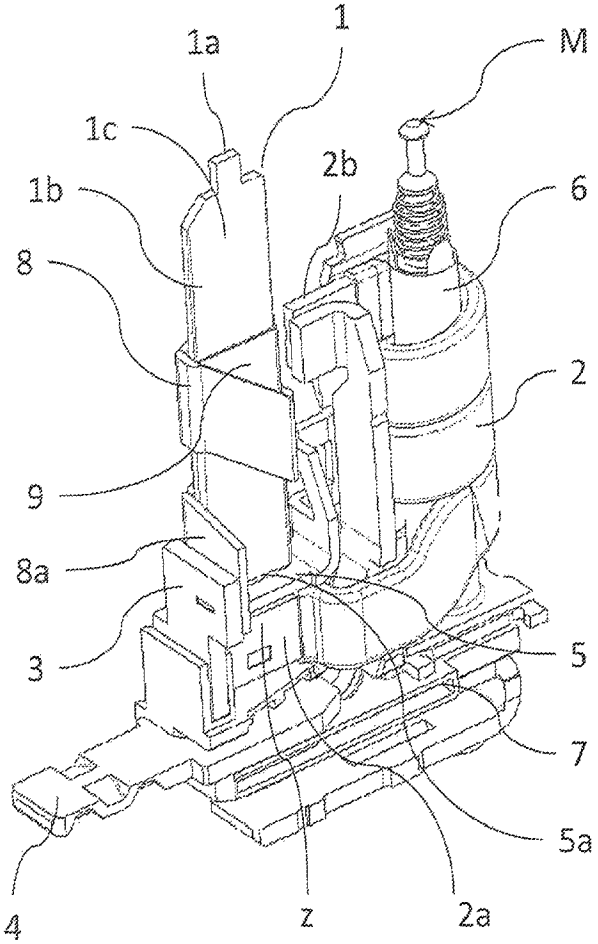
Figure 5:
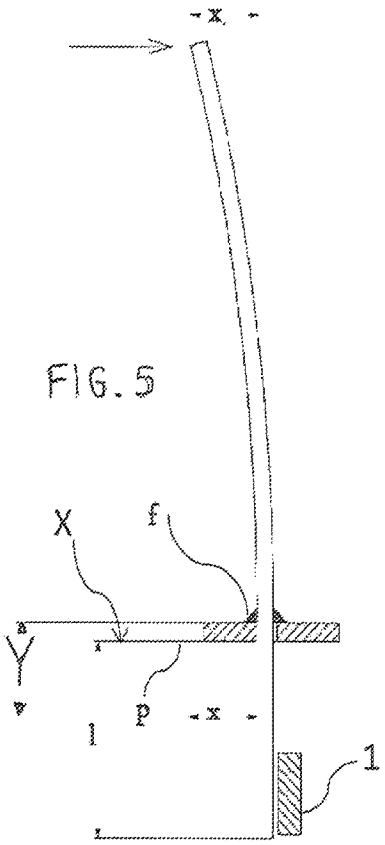
Figure 4:
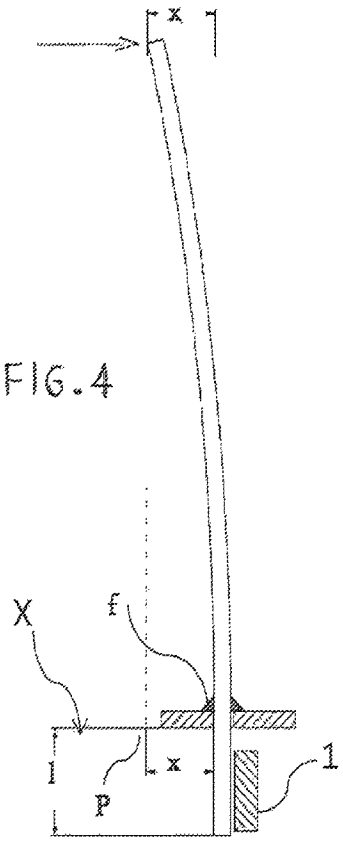

But further advantages and features of the invention will become more clearly apparent in the detailed description that follows and which refers to the attached drawings given solely by way of example and in which:

FIG. 1 is an exploded perspective view of a magneto-thermal trip according to the invention, FIGS. 2 and 3 are two perspective views illustrating this same device in two different orientations so as to show two opposite sides of this device, and FIGS. 4 and 5 respectively illustrate the deflection of the bimetal strip for two units respectively having a weak calibre and a strong calibre, said units comprising a joining device according to the invention.

FIGS. 1 to 3 illustrate a trip D, known as a magneto-thermal trip, belonging to a low voltage circuit breaker, this device comprising, in a manner known per se, a thermal trip T comprising a bimetal strip 1 and a magnetic trip M comprising a coil 2, said trips being mounted in series between a connection area 3, known as the input or upstream connection area, connected to the input terminal of the unit, and a connection area 4, known as the output or downstream connection area, electrically connected to the output terminal of the unit.

As illustrated in FIG. 1, this magneto-thermal assembly comprises a thermal assembly T and a magnetic assembly M. This thermal assembly comprises a bimetal strip 1 supported by a bimetal strip support 5, while the magnetic assembly M comprises a coil 2 supported by a core 6, these two assemblies being supported by an insulating support 7 designed to insulate the different parts from each other.

Such a thermal bimetal trip T is designed to provide protection against overcharges, the temperature rise of the bimetal strip 1 being representative of the temperature rise of the unit or of the protected electrical installation, so as to trip the switching unit when this temperature rise exceeds a predetermined threshold.

This temperature rise of the bimetal strip is obtained by passing current through the bimetal strip 1, and indirectly by passing current into an insulated electrical heater 8 in electrical contact with the bimetal strip. This heater 8, in tape form, is embodied in a material having an appropriate specific resistance and is pressed against a slim insulating sleeve 9 surrounding the bimetal strip 1, approximately between the two ends of the latter.

The tape 8 has a first end 8*a* that is electrically connected to a connection area 3 known as the input or upstream connection area leading to a current input terminal (not illustrated), and a second end 8*b* that is connected to the bimetal strip 1, for example by electric welding, at a particular point on the bimetal strip situated close to the free end 1*a* of same.

This bimetal strip is designed to be fixed to the abovementioned bimetal strip support 5, which support is designed to be fixed in the housing of the unit. This fixing of the bimetal strip is advantageously obtained by welding or brazing.

This coil 2 consists of a winding comprising a first end 2*a* that is electrically connected to the bimetal strip 1, and a second end 2*b* that is electrically connected to a downstream connection area 10 known as the output connection area that is connected to an output terminal of the unit.

According to the invention, the bimetal strip 1 is mounted so as to pass through an opening 5*a* made in the abovementioned bimetal strip support 5 so as to be able to be fixed to said support 5 at different locations of the bimetal strip chosen along the length of the bimetal strip 1. The bimetal strip thus has a first part 1*c* situated above the support 5 and situated on the side of its free end 1*a*, and a second part 1*d* situated below the support 5. A variable insertion position of the bimetal strip is thus obtained, making it possible to obtain a usable surface 1*b* of the bimetal strip that is also variable. It will be noted that this usable surface of the bimetal strip corresponds to its first part 1*c* situated above the support 5. The user will thus be able to choose the length of this usable surface depending on the calibre of the unit, as is more particularly illustrated in FIGS. 4 and 5.

The first end 2*a* of the coil 2 is electrically connected to the bimetal strip 1 in an area situated below the fixing area z of the bimetal strip 1 on the abovementioned support 5 as illustrated in FIGS. 2 and 3.

In FIG. 4, the bimetal strip 1 corresponds to that used in a unit having a low calibre. In this figure, the insertion length I of the bimetal strip 1 relative to the support 5 is minimal, the area of the bimetal strip situated below the support corresponding substantially to the area needed to fix the coil to the bimetal strip. In this configuration, the deflection of the bimetal strip 1 in the event of an electrical fault of thermal origin results in a curvature of its free end 1*a* that can be measured by a length x corresponding to a component of this deflection, this component corresponding to the length between the fixing point f of the bimetal strip on the support 5 and a point p corresponding to the projection of the free end 1*a* of the bimetal strip along an axis X, this axis X being substantially perpendicular to the longitudinal direction of the bimetal strip. This component x corresponds to the thermal profile of the bimetal strip. Corresponding to this thermal profile of the bimetal strip is a mechanical profile of the actuator designed to cooperate with this bimetal strip so as to cause the current switching unit to trip.

In FIG. 5, the bimetal strip 1 corresponds to that used in a unit having a high calibre. In this figure, the insertion length I is increased by a value Y compared with that of the bimetal strip of the preceding figure so as to reduce the usable surface 1*b* of the bimetal strip 1. The invention thus proposes to prolong the bimetal strip 1 through the part of the bimetal strip support 5 known as the flange, while preserving a weld, for example by laser, between the two parts, then directly to weld the end 2*a* of the winding of the coil 2 to the non-functional part 1*d* of the bimetal strip, below said flange.

Thus, by virtue of to the invention, the functions of inserting the bimetal strip and conducting the current are separate.

The current line therefore no longer passes through the end part of the bimetal strip having a reduced section, as is the case in the prior art.

The power generated by this subassembly is therefore reduced.

The insertion height of the bimetal strip can thus be adjusted so as to obtain the desired thermal profile. With strong currents, the fixing point of the bimetal strip on its support is raised in the direction of the free end of the bimetal strip so as to shorten the usable length of the bimetal strip. With weak currents, this fixing point will be lowered so as to lengthen the usable length of the bimetal strip and to heighten its thermal profile.

An adjustment depending on the current is therefore then possible so as to obtain a constant thermal profile, which allows a constant mechanical profile to be obtained throughout the range of one and the same product.

Due to this reduction of the generated power, it is possible to manufacture a protection unit having a higher calibre for a constant volume.

Of course, the invention is not limited to the embodiments described and illustrated, which have only been given by way of example.

On the contrary, the invention includes all the technical equivalents of the described means, and combinations thereof, provided that these are embodied according to its spirit.

The invention claimed is:

1. A device for joining a bimetal strip and a component that acts as a support for this bimetal strip in a current switching unit, said bimetal strip being electrically connected by a free end, to an input connection area, and by another end, by way of which this bimetal strip is fixed to the support, to an output connection area, wherein this bimetal strip is mounted so as to pass through the support so as to be able to be fixed at different locations along the length of said bimetal strip, said bimetal strip having a first and a second part that are situated respectively on one side and the other of the support, the first part being situated on the side of the free end of the bimetal strip, corresponding to the usable surface of said bimetal strip, the length of said usable surface being variable depending on the insertion length of said bimetal strip in the support, said insertion length being determined depending on the calibre of the unit so as to obtain a constant thermal profile, regardless of the calibre.

2. The joining device according to claim 1, wherein the output connection area, is electrically connected to the second part of the bimetal strip.

3. The joining device according to claim 1, wherein the bimetal strip is fixed to the support by welding.

4. An electrical protection unit comprising a thermal trip comprising a bimetal strip, comprising a device for joining the bimetal strip to its support according to claim 1.

5. The electrical protection unit according to claim 4, wherein an electromagnetic trip comprising a coil, comprising a first end electrically connected to the second part of the bimetal strip and a second end electrically connected to the output area.

6. The electrical protection unit according to claim 4, wherein said electrical protection unit is a low voltage circuit breaker.

* * * * *